US006290021B1

(12) United States Patent
Strandgaard

(10) Patent No.: US 6,290,021 B1
(45) Date of Patent: Sep. 18, 2001

(54) METHOD OF MANUFACTURING A SANDWICH BOARD AND A SOUND INSULATING STRUCTURE

(75) Inventor: Christian Strandgaard, Værløse (DK)

(73) Assignee: Sika AG, vorm. Kaspar Winkler & Co., Zurich (CH)

( * ) Notice: Subject to any disclaimer, the term of this patent is extended or adjusted under 35 U.S.C. 154(b) by 0 days.

(21) Appl. No.: 09/541,281

(22) Filed: Apr. 3, 2000

Related U.S. Application Data

(63) Continuation-in-part of application No. PCT/DK97/00436, filed on Oct. 9, 1997, now abandoned.

(51) Int. Cl.[7] ..... E04B 1/82; E04B 2/02

(52) U.S. Cl. ..... 181/290; 181/296; 181/285; 428/45; 428/138; 52/145; 52/742.1; 52/783.1

(58) Field of Search ..... 181/290, 294, 181/296, 285, 286, 292; 428/44, 45, 49, 138; 52/145, 238.1, 380, 741.4, 742.1, 742.12, 746.1, 783.1

(56) References Cited

U.S. PATENT DOCUMENTS

| | | | | |
|---|---|---|---|---|
| 3,215,225 | | 11/1965 | Kirschner . | |
| 3,424,270 | | 1/1969 | Hartman et al. . | |
| 4,515,239 | * | 5/1985 | Blatt et al. | 181/290 |
| 4,917,284 | * | 4/1990 | Candiracci | 228/5.1 |
| 5,080,950 | * | 1/1992 | Burke | 428/81 |
| 5,114,510 | * | 5/1992 | Wright | 156/82 |
| 5,230,844 | * | 7/1993 | Macaire et al. | 264/46.7 |
| 6,080,495 | * | 6/2000 | Wright | 428/623 |

FOREIGN PATENT DOCUMENTS

| | | | | |
|---|---|---|---|---|
| 1 201 083 | | 9/1965 | (DE) . | |
| 2706969-A1 | * | 8/1978 | (DE) | B63B/03/68 |
| 3444992-A1 | * | 5/1986 | (DE) | 114/85 |
| 948483 | | 2/1964 | (GB) . | |
| 02109793-A | * | 4/1990 | (JP) | 114/61.3 |

* cited by examiner

*Primary Examiner*—Robert E. Nappi
*Assistant Examiner*—Edgardo San Martin
(74) *Attorney, Agent, or Firm*—Thomas R. Vigil

(57) ABSTRACT

A sound insulating structure (12) comprises first layer plates (30) arranged in coplanar and contiguous relationship in order to form a first structural layer, second layer plates (13) arranged in coplanar relationship in order to form a second structural layer in spaced parallel relation with the first structural layer, and a core (6), which core effectively bridges the space between and adheres together plates of the respective layers, and which core comprises an elastic, vibration deadening mass. At least one through opening is provided in each of the second layer plates with the purposes of permitting escape of any trapped air and of permitting inspection of the space between the structural layers while the mass in the core sets to an elastic state. The invention also provides a panel and a method of manufacturing a sandwich board.

19 Claims, 4 Drawing Sheets

Fig. 5
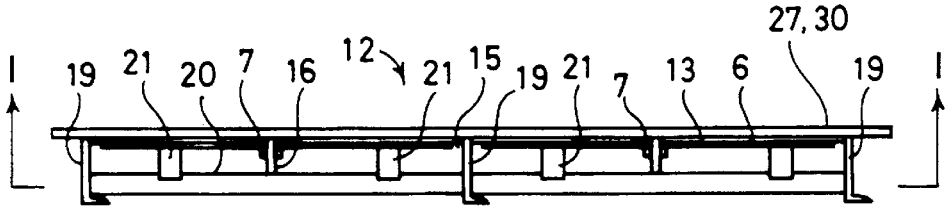
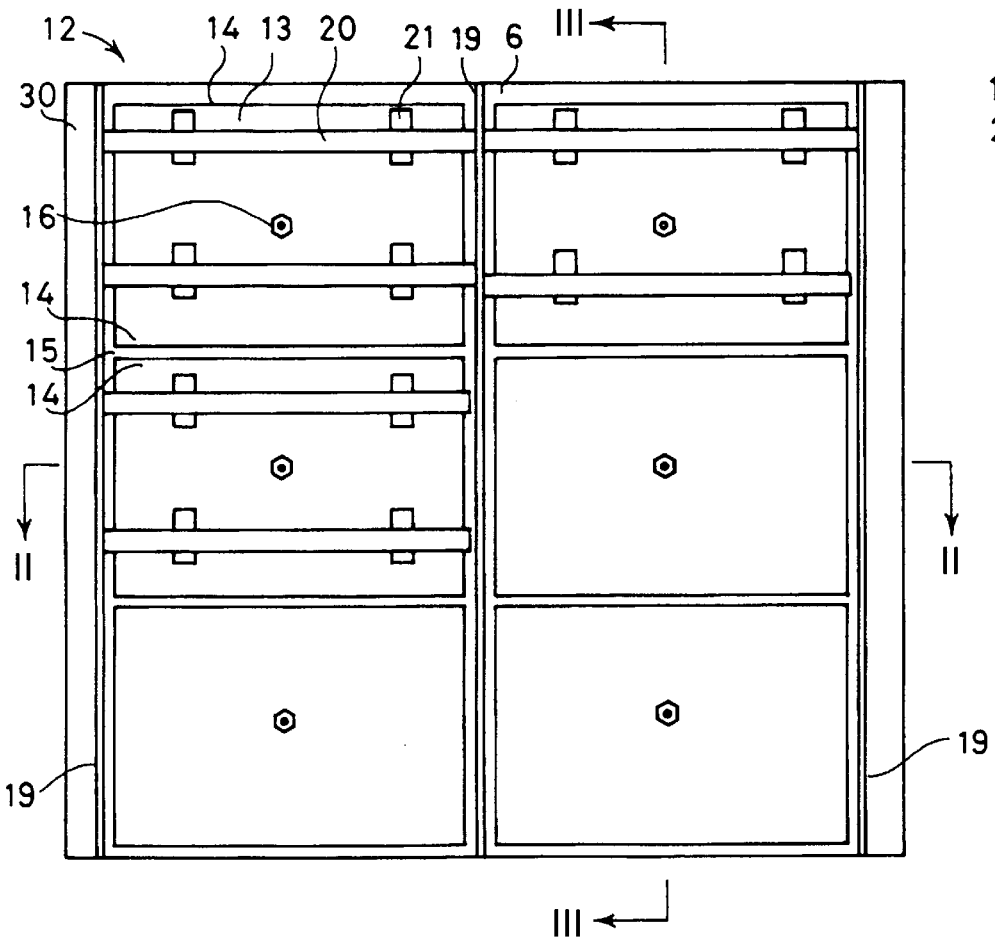
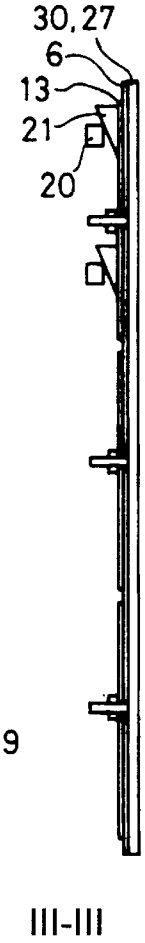
I-I Fig. 4
Fig. 6

METHOD OF MANUFACTURING A SANDWICH BOARD AND A SOUND INSULATING STRUCTURE

CROSS-REFERENCE TO RELATED APPLICATIONS

This is a continuation-in-part of International Patent Application PCT/DK97/00436 with an international filing date of Oct. 9, 1997 now abandoned.

BACKGROUND OF THE INVENTION

1. Field of the Invention

The present invention relates to a method of manufacturing a sandwich board. The invention further relates to a panel for application as a wall panel, a ceiling panel or a floor panel and to a sound insulating structure for use as a wall, a ceiling or a floor.

The invention particularly, although not exclusively, pertains to environments where space is scarce, such as in accommodations on board ships.

2. Description of the Prior Art

DE patent 34 44 992 C2 discloses a floor structure for accommodations on board ships and designed for sound insulation. According to this teaching a tile is manufactured by making out of 1 mm steel plate a shallow box with open top and pouring into this box a mixture comprising a PU based adhesive together with fillers. Once the compound has set, the tile is turned upside down and placed onto and adhered to a steel deck. Tiles made in this way are placed close together to build a floor cover layer. Where particular requirements to gas sealing prevail this floor-covering may be covered by a 0.5 mm steel plate adhered on top of the tiles and this structure may be topped by a carpet.

DE published application 27 06 969 B2 discloses a sound damping floor structure for use on ships and comprising a layer of mineral fiber material covered with a steel plating. The butt joints between sections of the steel plating are secured by fish plates arranged below the steel plating and on top of the mineral fiber material. The publication suggests adhering the fishplates to the steel platings by two-component polyurethane adhesive.

It is considered known in the art of ship building to build a sound attenuating floor structure by placing on top of a steel deck a mineral fiber wool layer, a first structural layer of steel plates, a layer of viscoelastic polyurethane, a second structural layer of steel plates and a carpet. Steel plates in the first structural layer are interconnected along the butt joints by spaced weldings for structural reasons. As part of the process of building this floor, the viscoelastic polyurethane is poured while in a viscous or fluent state on top of the first structural layer and screeded. Steel plates for the second structural layer are placed on top of the viscous layer and ballasted until the viscoelastic mass has set.

The inventor has discovered that the efficiency in terms of sound and vibration reduction capability of this floor is critically dependent on the accurate controlling of the thickness of the viscoelastic layer and on achieving full face contact between the viscoelastic layer and the steel plates of the two structural layers. However, lack of planety of the top surface of the viscous layer, unavoidable distortions of the steel plates, trapped air and the difficulty of inspecting the viscous layer while in the process of setting may give rise to difficulties during construction and imperfections in the result.

These difficulties are according to the state of the art encountered by using for the second structural layer steel plates of comparatively small formats, e.g. no more than 60×60 cm, by using heavy ballasting and by careful work. This complicates the procedure and the small formats of the steel plates of the second structural layer limits the structural rigidity provided by this floor. Furthermore, level offsets between adjacent plates require extensive filling, which has to be done using the same viscous compound as used below the second structural layer, which compound is costly and difficult to apply.

SUMMARY OF THE INVENTION

The invention, in a first aspect, provides a method of manufacturing a sandwich board, said sandwich board comprising a first sheet, a second sheet and a core, said core comprising an elastic, vibration deadening compound effectively bridging the space between and adhering together said sheets, said method comprising the steps of providing at least one through opening in said second sheet, applying a coating of compound onto at least one of said sheets, placing said first and said second sheet in overlaying, mutually spaced relationship with said coating in an intermediate position, applying a compression force onto said sheets in order to urge them together, using said opening to inspect the space between the sheets and to inspect said coating, adjusting the compression force as appropriate depending on an evaluation of the result of the inspection, and allowing said compound to set to an elastic, vibration deadening state whereby to provide said core.

According to this method at least one through opening is provided in the sheet of the second layer. A greater number of openings may be provided as appropriate. The openings permit the inspection of the space between the sheets and thus of the thickness of the viscous layer. The openings permit the escape of any trapped air. The openings further permit the injection of additional viscous mass if required. Should the inspection reveal that the space between the sheets was too wide, e.g. due to local distortions of the plates, it is easy to adjust the compression force applied on the top sheet to correct the situation. Once the viscous mass has set it adheres together the plates and the compression force may be relieved.

The method according to the invention applies to sandwich boards useful for floor coverings as well as for wall structures or ceiling structures. The sheets may comprise any kind of structural plate material, in particular plates of steel, aluminum or other metals. The sandwich board may or may not be backed by other materials also selected for sound attenuating properties, e.g. mineral fiber wool. In case no backing is used, a steel deck, a bulkhead or a ceiling plate may provide the first sheet.

The spacer means may be provided by installing a set of structural spacers, e.g. pads of wood, steel, mineral wool or other material, or the spacer means may be provided by applying a filling of viscoelastic mass and allowing it to set to form a coating on one of or both of said sheets. Pretreatment of at least one of the sheets by applying a filling of viscoelastic mass and allowing it to set at least until assuming a viscous state prior to the step of bringing together the sheets is of particular advantage when installing the sandwich boards for wall panels or ceiling panels where a pouring in situ of a fluent mass might be difficult.

According to a preferred embodiment, the surface of the coating is textured, e.g. by pouring the viscous mass in a fluent state on to a textured foil material and placing the sheet on top. Texturing the surface of the coating provides a simple manner of controlling effectively the thickness of the coating.

According to a preferred embodiment, the filling of the viscoelastic mass is topped up subsequent to the step of bringing together the sheets by injecting additional mass in a viscous or fluent state and allowing it to set. This ensures the complete filling of the space between the sheets.

According to a preferred embodiment, injection of mass is continued until it has been observed that excess mass is being driven out past the sheet edge along the whole sheet contour.

According to a preferred embodiment, the sheets are interconnected, at least until the mass has set, by a structural component, such as a bolt, serving to secure the relative positions of the sheets. This structural component is easily introduced through an opening in the second sheet. This precaution secures the relative positions of the sheets, thus facilitating subsequent operations, such as bringing in additional ballast or adjusting the compression force since there is no danger that these operations will offset the sheet from the intended position. The additional structural component may also be utilized to apply all of or part of the compression force. E.g. a bolt could be welded to the first sheet and a nut and washer engaging the bolt could be tightened to force the second sheet closer to the first sheet. If the opening is provided in the center of the second sheet, one bolt with a washer and optionally a plate or similar for distributing the force could be used to hold down the second sheet.

The invention, in a second aspect, provides a panel suitable for the application as a wall panel, a ceiling panel or a floor panel, comprising a first sheet, a second sheet and a core, said core comprising an elastic, vibration deadening compound effectively bridging the space between and adhering together said sheets so as to provide a sandwich board structure, wherein at least one through opening has been provided in said second sheet, a coating of compound has been applied onto at least one of said sheets, said first and said second sheet have been placed in overlaying, mutually spaced relationship with said coating in an intermediate position, a compression force has been applied onto said sheets in order to urge them together, said compression force has been adjusted as appropriate depending on an evaluation of the result of an inspection through said opening, and wherein said compound has set to an elastic, vibration deadening state whereby to provide said core.

This panel could comprise any number of sandwich boards or composite sandwich boards made by the inventive methods.

According to a preferred embodiment, the first and second sheets comprise steel plates or aluminum plates, and the gauge of the second sheet is equal to or less than the gauge of the first sheet. Using a small gauge of steel or aluminum plating for the second sheet reduces sound reflection and sound radiation from the panel and to the adjacent side.

According to a preferred embodiment, the compound comprises a viscoelastic damping mass based on polymer. Particularly preferred polymers comprise polyurethane and acrylate.

The invention, in a third aspect, provides a sound insulating structure for use as a wall, a ceiling or a floor, comprising first plates, arranged in coplanar and contiguous relationship in order to form a first structural layer, second layer plates arranged in coplanar relationship in order to form a second structural layer in spaced parallel relation with said first structural layer, and a core, which core effectively bridges the space between and adheres together plates of the respective layers, and which core comprises an elastic, vibration deadening mass, wherein said structure has been manufactured by providing at least one through opening in each of said second plates, applying compound onto at least one of said first or said second layer plates to provide at least part of said core, bringing together plates of said second structural layer with plates of said first structural layer, applying a compression force in order to urge said plates of respective structural layers together, using said openings to inspect the space between the structural layers, adjusting the compression force as appropriate depending on an evaluation of the result of the inspection, and allowing said mass in said core to set to an elastic state.

This structure may provide a wall, a ceiling or a floor, which combines the advantages of a superior performance in terms of sound and vibration insulation with ease of manufacturing and comparatively low cost of materials. This structure may be combined with other structures, such as soft layers for added sound attenuation, or it may be used as the sole structural component relied upon for sound and vibration attenuation. The inventive structure is easily combined with other structural components as may be installed for various purposes, e.g. for enhancing esthetic value, etc.

BRIEF DESCRIPTION OF THE DRAWINGS

Further objects and features of the invention will appear from the following detailed description of preferred embodiments, which is given with reference to the appended drawings on which FIG. 4 illustrates a portion of a wall structure according to the invention in plan view, FIG. 5 is a section by the line II—II in FIG. 4, FIG. 6 is a section by the line III—III in FIG. 4.

BEST MODE FOR CARRYING OUT THE INVENTION

All the drawings are schematic, not necessarily to scale and illustrate only parts essential to enable those skilled in the art to practice the invention whereas other parts are omitted from the drawings to preserve clarity. Throughout the drawings identical or similar parts are designated by the same references.

Figure 1:
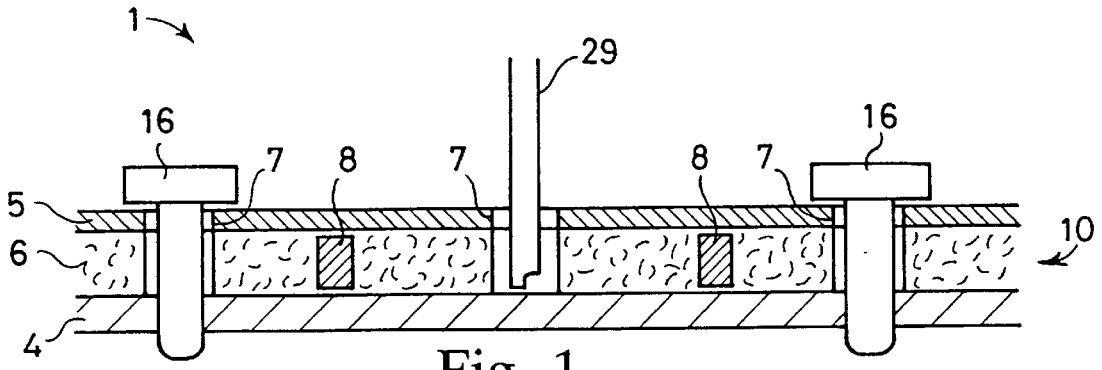
FIG. 1 shows a transverse section through a part of a panel according to a first embodiment of the invention.

FIG. 1 illustrates a section through part of a sandwich board 1 according to the first embodiment of the invention. This sandwich board comprises a first sheet 4, a core 6 and a second sheet 5, all in a sandwiched relationship. The core 6 effectively fills the space 10 between the sheets. The second sheet 5 is provided with openings 7 which extend also through the body of the core.

FIG. 1 illustrates bolts 16 inserted through two of these holes to engage tapped holes in the first sheet 4. These bolts, which may be provided with washers or plates for force distribution, may be operated to apply and control a compression force, pressing together the first and second sheets.

One of the openings 7 illustrated between the two bolts in FIG. 1 has not been used for the insertion of a bolt, but has been left open so as to permit the insertion of a probe 29 by which the depth of the hole and hence the thickness of the core or the sheet interspace may be gauged accurately.

Preferred materials for the sheets are steel plates and according to a preferred embodiment the gauge of the second sheet is equal to or less than the gauge of the first sheet. An embodiment in which the first sheet has a thickness of 3 mm, the second sheet a thickness of 1.5 mm and the core a thickness of about 1 mm has been tested and found to perform well.

Spacers 8 illustrated in FIG. 1 and serving to control the spacing 10 between the sheets may comprise pads of steel, wood, or mineral wool or any other solid matter.

The sandwich board illustrated in FIG. 1 may be manufactured in customized formats or lengths or it may be manufactured in standardized formats, referred to as panels, to provide a prefabricated structural component, which may be installed as a unit. The sandwich board may also be manufactured in situ using e.g. a deck or a bulkhead as the first sheet.

Figure 2:
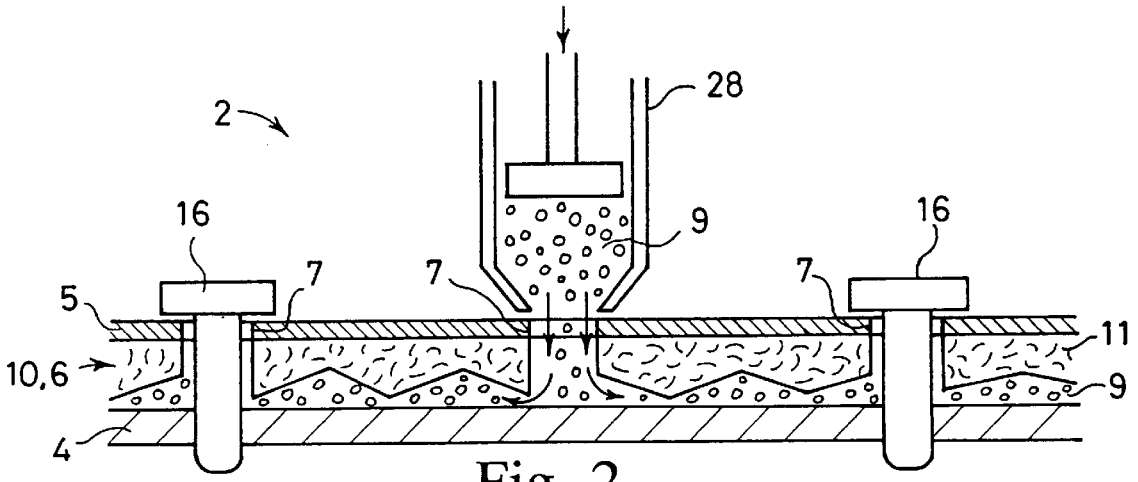
FIG. 2 illustrates a panel according to a second embodiment of the invention in a view similar to that of FIG. 1.

Reference is now made to FIG. 2 illustrating a sandwich board 2 according to a second embodiment of the invention. In the embodiment of FIG. 2 the second sheet has been pre-treated by the application of a coating of a compound. A preferred method of applying this coating comprises pouring the compound in a fluent state on to a sheet of textured foil, placing the plate intended for providing the second sheet on top and allowing the compound to set at least partially to assume a viscous state.

This procedure facilitates controlling the thickness of the layer of compound, which might otherwise be difficult as the compound is generally poured in a rather fluent state and as the sheet might be distorted. Subsequent to the partial setting, the textured foil is removed and the second sheet 5 treated with the partly set compound, which provides the coating 11, is placed on to the first sheet 4 and secured by a bolt 16. In the second embodiment the textured coating 11 effectively provides a means for spacing the sheets.

An embodiment in which a coating was applied to a thickness of 0.7 mm and an extra layer to a thickness of approximately 0.3 mm was injected, has been tested and found to perform well.

Once the second sheet has been secured, an additional amount of compound in a viscous or fluent state may be injected through one or more of the openings 7 by placing a gun 28 in registry with the opening. Sufficient injection pressure is applied to drive fluent compound 9 into the interspace between the surface of the coating 11 and the first sheet 4 to fill this volume and provide full surface contact between the coating and the first sheet. Injection may be continued until egress of surplus compound has been observed along the full contour of the second sheet.

Figure 3:
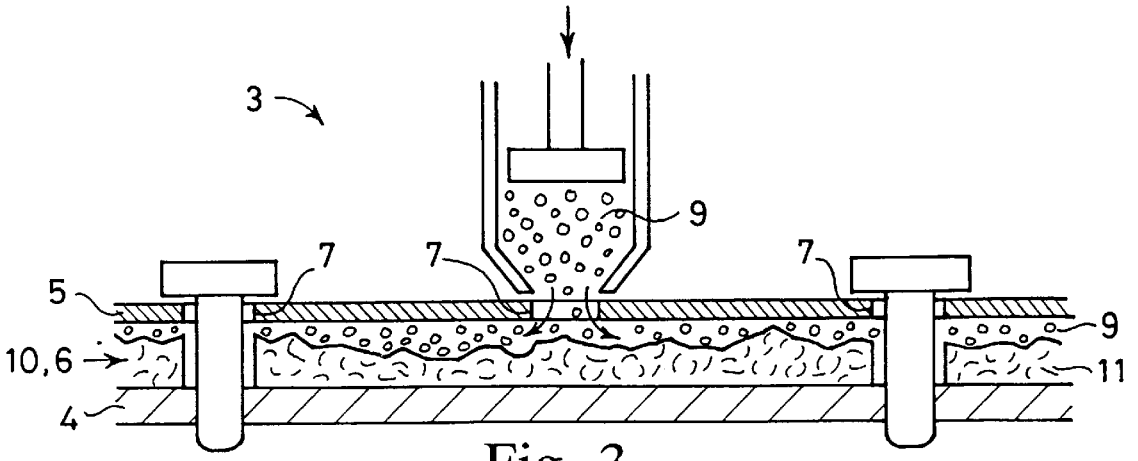
FIG. 3 illustrates a panel according to a third embodiment of the invention in a view similar to that of FIG. 1.

Reference is now made to FIG. 3 for an explanation of a sandwich board 3 according to a third embodiment of the invention.

In the third embodiment, a compound in a viscous or fluent state is initially applied on to the surface of the first sheet 4 and allowed to set at least partially to a viscous state. The surface of the compound is leveled or screeded. However, by the method according to the invention, a certain amount of departures from a level surface may be tolerated. In FIG. 3, the departures from the flat state are grossly exaggerated for the sake of illustration. The semi-set compound provides a coating 11.

Subsequently, the plate forming the second sheet 5 is placed into contact with the surface of the coating 11 and secured by bolts 16 similarly as explained above. The semi-set coating 11 serves as spacer means to control the spacing between the sheets.

The gun 28 is placed in registry with one of the openings 7 and a compound 9 in a fluent or viscous state is injected at a pressure sufficient to drive it into the interspace between the coating 11 and the second sheet 5 to effectively fill this volume and ensure a full surface contact with the second sheet.

The compound 9 and the coating 11 are allowed to set completely and the bolts may be removed or ground away or they may be left in place as appropriate.

According to other preferred embodiments (not shown), stay bolts are secured to the first sheet by welding instead of by threaded engagement in tapped holes, and the second sheet is secured by nuts in threaded engagement with respective stay bolts.

Reference is now made to FIGS. 4, 5 and 6 for an explanation of a wall structure according to the invention. The wall structure 12 effectively comprises a plate in a first layer 30, a core 6 and a plate in a second layer 13. The first layer plate 30 in this case effectively comprises a bulkhead 27. The bulkhead is provided with protruding and flanged ribs 19. Onto this bulkhead, compound and second layer plates 13 are applied, basically using any of the methods explained above. The second layer plates 13 are laterally spaced in order to leave gaps 15 between the contours 14 of adjacent plates.

The flanged ribs 19 (refer in particular to FIG. 5) are utilized to attach laths 20 extending across the second layer plates in spaced relationship. Wedges 21 are driven down between the laths and the outside of the second layer plates 13 in order to apply a compression force holding the second layer plates tightly against the first layer plate 30. Each of the second layer plates 13 has been provided with a central opening similarly as explained above and a bolt has been inserted through this opening to secure each of the second layer plates 13.

The central bolt in each of the second layer plates 13 provides the possibility of quickly placing the plates and securing them after which ample time may be taken to attach the laths and drive in the wedges. The bulkhead and the second layer plates may have been pre-treated with the compound, and additional compound may be injected after the plates have been placed in the positions illustrated in FIG. 4, using openings in the plates (not illustrated in the figures).

In cases where there are no protruding ribs, additional bolts may be inserted through openings in the plates and tightened to provide compression force as required. A ceiling structure or a floor structure may be built by similar methods.

Figure 7:
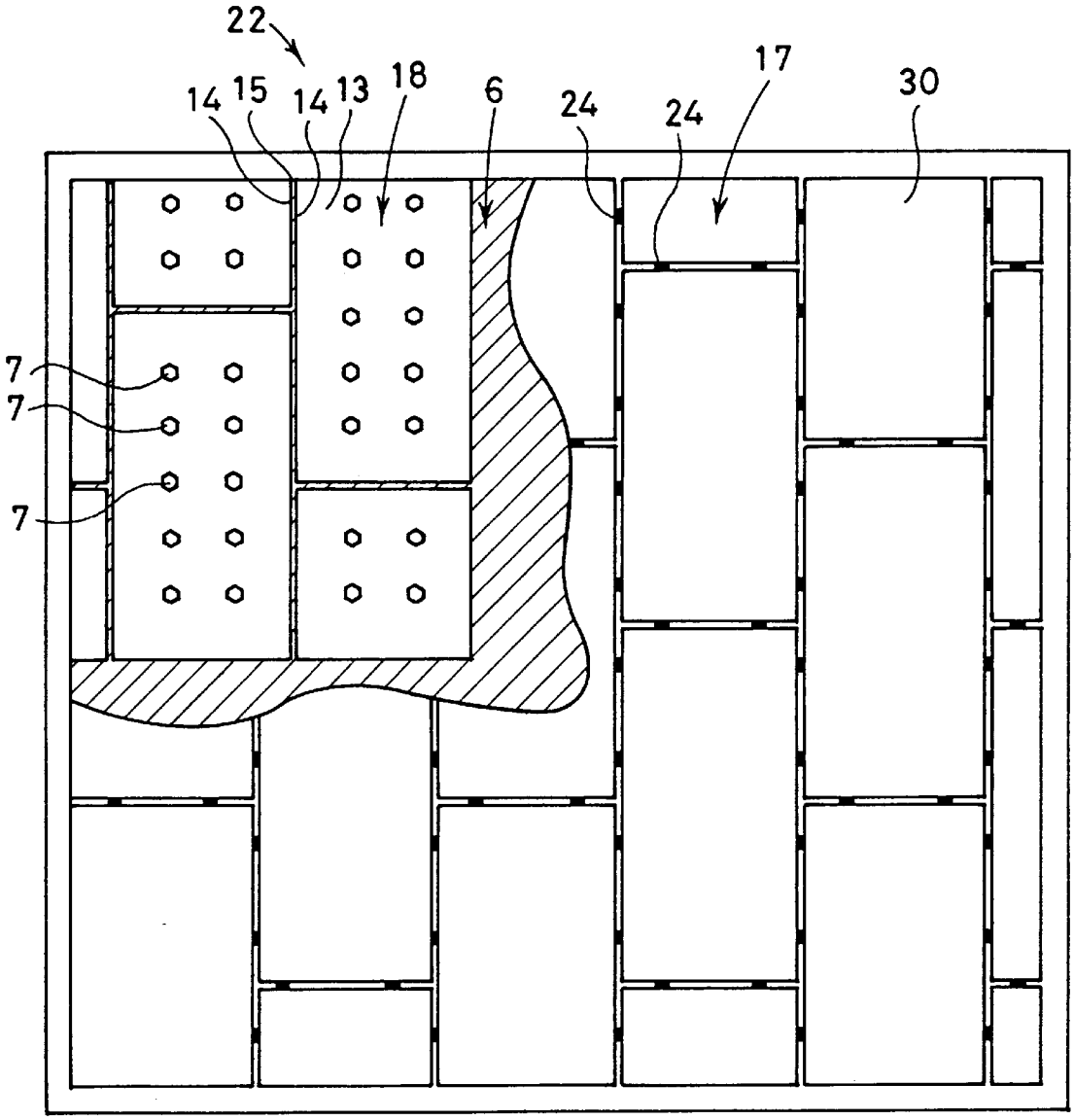
FIG. 7 illustrates a floor structure according to the invention in plan view, with portions of the upper layers removed for the purpose of illustration.
Figure 8:
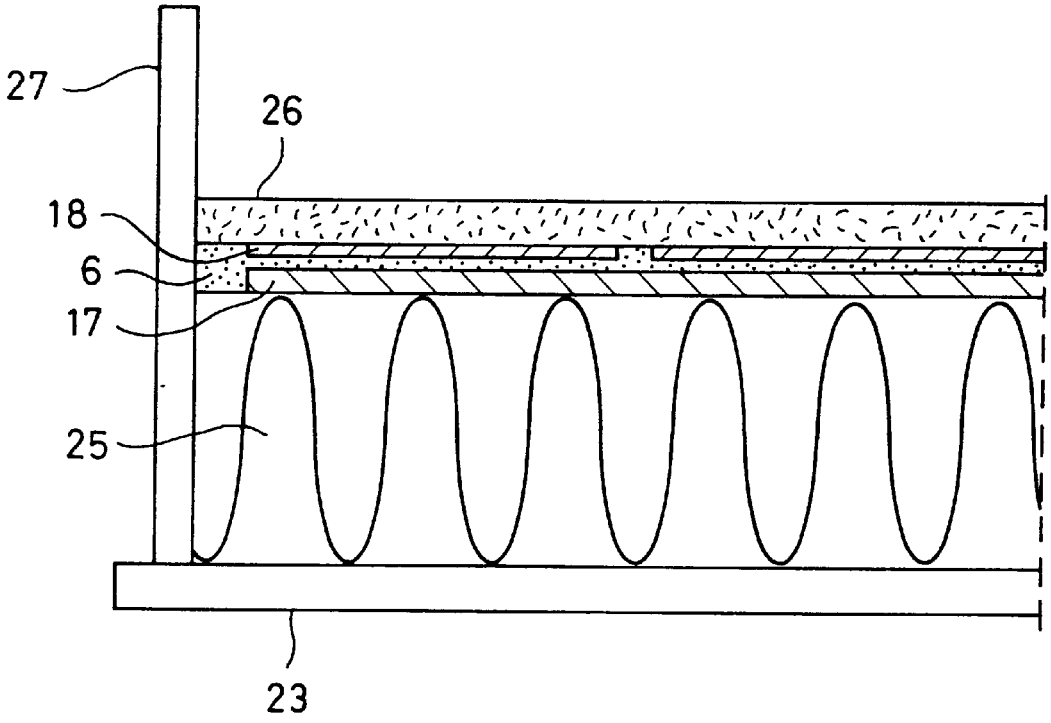
FIG. 8 illustrates a vertical section through part of the floor structure of FIG. 7.

Reference is now made to FIGS. 7 and 8 for an explanation of a floor structure provided by the invention. Referring more particularly to FIG. 8 this floor structure 22 basically is installed on top of a deck 23 and essentially comprises a layer of mineral fiber wool 25, a first structural layer 17, a core 6 of elastic vibration deadening compound, a second structural layer 18 and a carpet 26 on top. The edges of the first structural layer and the second structural layer are spaced laterally from the bulkhead 27 in order to decouple any transmission of vibrations.

Referring more particularly to FIG. 7 the method of the installing this floor structure essentially is carried out as follows.

Initially, mats of mineral fiber wool 25 are placed to cover all of the deck 23. First layer plates 30 to provide the first structural layer 17 are placed in abutting relationship and are secured by spaced butt welds 24 for structural reasons.

On top of these plates, compound is poured and leveled or screeded to provide a layer adapted for forming part of the core 6. On top of the layer of compound, second layer plates 13 adapted for providing the second structural layer 18 are placed in juxtaposition with lateral gaps or spaces 15 between the margins 14 of adjacent plates. These second layer plates 13 are provided with regularly spaced openings 7 as illustrated in the figure. The plates of the first structural layer are secured to those of the second structural layer by welding through at least some of the openings as appropriate. Additional compound may be injected through any openings available as appropriate. Once the compound has set, the structure is finished by removing protruding bolts as appropriate and by placing a carpet 26 on top.

Alternative methods of securing together the plates of the two structural layers comprise the insertion of screws or rivets.

An exemplary structure has been manufactured by this method. The exemplary structure comprised 40 mm of rock wool, 3 mm plates for the first structural layer in formats of 100×200 cm, a 1 mm layer of compound and 1.5 mm plates for the second structural layer also in formats of 100×200 cm. The second layer plates were provided with openings in a regular grid with 10 cm intervals. The structural rigidity provided by this floor is superior to that provided by a comparable floor of the prior art due to the larger format of plates used in the second structural layer and due to the better control over the surface bonding of the second structural layer.

Although specific embodiments of the invention have been explained above, this explanation has been presented for illustrative purposes only and it is intended that the scope of the invention should be limited only by the terms of the appended claims.

I claim:

1. A method of manufacturing a sandwich board, said sandwich board comprising a first sheet, a second sheet and a core, said core comprising an elastic, vibration deadening compound effectively bridging the space between and adhering together said sheets, said method comprising the steps of providing at least one through opening in said second sheet, applying a coating of compound onto at least one of said sheets, placing said first and said second sheet in overlaying, mutually spaced relationship with said coating in an intermediate position, applying a compression force onto said sheets in order to urge them together, using said opening to inspect the space between the sheets and to inspect said coating, adjusting the compression force as appropriate depending on an evaluation of the result of the inspection, and allowing said compound to set to an elastic, vibration deadening state whereby to provide said core.

2. The method according to claim 1, comprising, prior to the step of applying a compression force onto said sheets, the step of attaching spacer means onto at least one of said sheets, said spacer means being adapted for controlling the spacing between the sheets.

3. The method according to claim 2, comprising the step of attaching said spacer means by applying a filling of said compound in a viscous or fluent state to form a coating on said at least one sheet, and allowing the filling to set until assuming a viscous state.

4. The method according to claim 3, comprising the step of allowing said coating to set completely.

5. The method according to claim 3, comprising the step of texturing the surface of said coating.

6. The method according to claim 1, comprising the step of introducing through said opening and into said space a supplementary filling of said compound while in a viscous or fluent state.

7. The method according to claim 6, comprising the step of continuing the introduction of said supplementary filling until outflow of excess compound around at least part of the margin of at least one of the sheets is observed.

8. The method according to claim 1, comprising the step of providing a structural component, such as a screw, a bolt, a rivet or a piece of welding for interconnecting said sheets, adapted for securing their relative positions.

9. The method according to claim 8, comprising the step of utilizing said structural component to apply at least part of said compression force.

10. The method according to claim 1, wherein the step of providing said opening comprises providing said opening in the center of said second sheet.

11. The method according to claim 1, comprising the step of providing said second sheet with a number of openings with regular spacings.

12. A panel suitable for the application as a wall panel, a ceiling panel or a floor panel, comprising a first sheet, a second sheet and a core, said core comprising an elastic, vibration deadening compound effectively bridging the space between and adhering together said sheets so as to provide a sandwich board structure, wherein at least one through opening has been provided in said second sheet, a coating of compound has been applied onto at least one of said sheets, said first and said second sheet have been placed in overlaying, mutually spaced relationship with said coating in an intermediate position, a compression force has been applied onto said sheets in order to urge them together, said compression force has been adjusted as appropriate depending on an evaluation of the result of an inspection through said opening, and wherein said compound has set to an elastic, vibration deadening state whereby to provide said core.

13. The panel according to claim 12, wherein said first and second sheets comprise steel plates, and wherein the gauge of said second sheet is equal to or less than the gauge of said first sheet.

14. The panel according to claim 12, wherein said first and second sheets comprise aluminum plates, and wherein the gauge of said second sheet is equal to or less than the gauge of said first sheet.

15. The panel according to claim 12, wherein said compound comprises a visco-elastic damping mass based on polymer.

16. A sound insulating structure for use as a wall, a ceiling or a floor, comprising first plates, arranged in coplanar and contiguous relationship in order to form a first structural layer, second layer plates arranged in coplanar relationship in order to form a second structural layer in spaced parallel relation with said first structural layer, and a core, which core effectively bridges the space between and adheres together plates of the respective layers, and which core comprises an elastic, vibration deadening mass, wherein said structure has been manufactured by providing at least one through opening in each of said second plates, applying compound onto at least one of said first or said second layer plates to provide at least part of said core, bringing together plates of said second structural layer with plates of said first structural layer, applying a compression force in order to urge said plates of respective structural layers together, using said openings to inspect the space between the structural layers, adjusting the compression force as appropriate depending on an evaluation of the result of the inspection, and allowing said mass in said core to set to an elastic state.

17. The structure according to claim 16, wherein spacer means is attached onto at least one of said first or second plates, said spacer means serving to control the spacing between the plates of the respective structural layers.

18. The structure according to claim 16, wherein said first layer plates are structurally interconnected at their edges by welding, prior to the step of bringing together plates of the respective layers.

19. The structure according to claim 16, wherein the plates of at least one of said structural layers are provided with a backing comprising a layer of soft, sound deadening material, such as mineral fiber wool.

* * * * *